United States Patent [19]

Nye

[11] Patent Number: 4,834,463

[45] Date of Patent: May 30, 1989

[54] PAVEMENT PLANER

[76] Inventor: Edward L. Nye, 76 Yeager Dr., Shippensburg, Pa. 17257

[21] Appl. No.: 197,435

[22] Filed: May 23, 1988

[51] Int. Cl.[4] ..... E01C 23/12

[52] U.S. Cl. ..... 299/39; 404/90; 414/523

[58] Field of Search ..... 404/90, 91; 299/39, 299/64; 414/505, 523, 528; 198/317, 861.6; 49/381; 403/79.157, 158

[56] References Cited

U.S. PATENT DOCUMENTS

| | | | |
|---|---|---|---|
| 4,037,981 | 7/1977 | Wirtgen | 404/91 |
| 4,193,636 | 3/1980 | Jakob | 299/39 |
| 4,195,946 | 4/1980 | Swisher, Jr. | 404/75 |
| 4,647,248 | 3/1987 | Wirtgen | 404/90 |
| 4,723,867 | 2/1988 | Wirtgen | 404/90 |

*Primary Examiner*—Jerome W. Massie
*Assistant Examiner*—Matthew Smith

[57] ABSTRACT

The planer has a planer drum drivenly supported in a chassis, and a drum-access bulkhead, mounted for pivotable movement about a vertical axis, in confronting adjacency to the drum. An extended conveyor, for carrying off planed-off pavement material, is mounted, at one end thereof, to the bulkhead. Accordingly, the conveyor can be slued fully aside, upon the bulkhead being pivoted about the axis, to provide clear, open access to the drum for servicing thereof.

7 Claims, 3 Drawing Sheets

PAVEMENT PLANER

This invention pertains to pavement-milling or -planing machines which, as is customary, have conveyors for conducting planed-off material to dump trucks (or like disposal vehicles), and in particular to a pavement planer having a novel conveyor mounting arrangement which facilitates servicing of the machine's planer element (i.e., drum or the like).

Pavement planers, of the type to which the invention pertains, are disclosed in U.S. Pat. Nos. 4,193,636, issued to H. E. Jacobs, on Mar. 18, 1980, for an "Asphalt Paving Planer with Conveyor Forwardly of Cutting Drum", and 4,195,946, for a "Method for Resurfacing a Paved Roadway", issued to George W. Swisher, Jr., on Apr. 1, 1980.

The more popular pavement planers, or milling machines, such as the MT-6250, or MW-6250 which are manufactured by Ingersoll-Rand Company, in Shippensburg, Pa., employ a front-loading conveyor. The downstream end of the conveyor, of course, is located in near adjacency to a chassis-carried, powered, carbide-toothed cutter drum. Now then, to service the drum—to replace worn carbide teeth, for instance—it has been necessary either to remove the obstructing conveyor, or to rotate the conveyor, vertically, up over the chassis (and operator). Both of these practices are undesirable and, accordingly, a more facile manner of conveyor disposition, enabling drum servicing, has long been sought.

It is an object of this invention, therefore, to provide the long sought, improved manner of conveyor disposition or articulation.

It is, particularly, an object of this invention to set forth a pavement planer comprising a chassis having a given, horizontal, travel axis; a planer element carried by said chassis; and an extended conveyor; wherein said chassis has an access bulkhead, mounted for pivotable movement about a vertical axis, in confronting adjacency to said planer element; and said conveyor is mounted, at one end thereof, to said bulkhead; whereby said conveyor is slued across said travel axis upon said bulkhead being pivoted about said vertical axis.

Further objects of this invention, as well as the novel features thereof, will become more apparent by reference to the following description taken in conjunction with the accompanying figures, in which.

Figure 1:
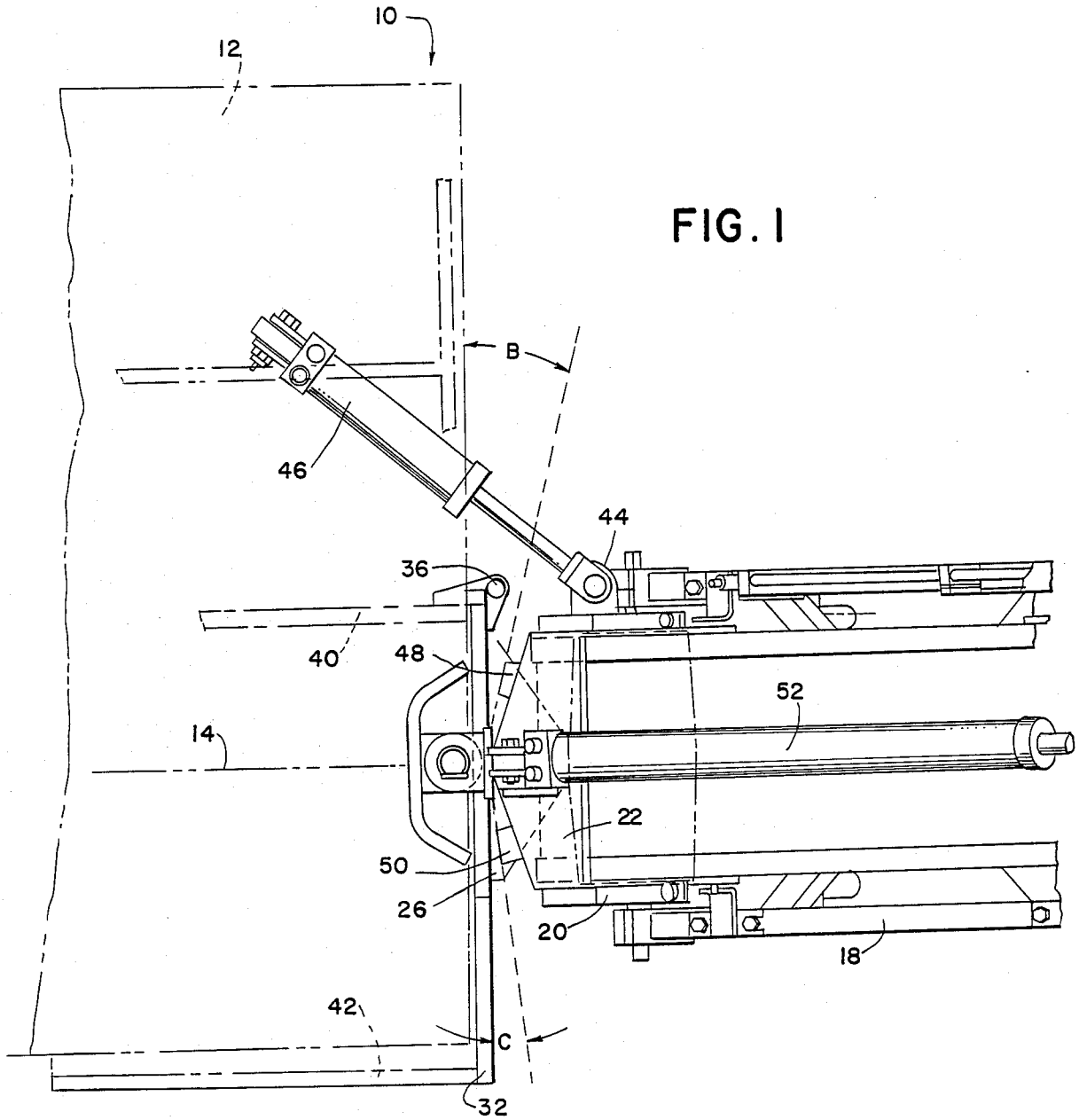
FIG. 1 is a plan view of a portion of a chassis of a pavement planer, in phantom, and a portion (downstream end) of a conveyor in full lines, illustrative of an embodiment of the invention.

As shown in the figures, a pavement planer 10, embodying the invention, comprises a chassis 12 (shown only in phantom) having a given, horizontal, travel axis 14. The planer 10 has a powered, planer drum 16 shown only as a simple circle (in FIG. 2). It is well understood, however, by those of ordinary skill in this art that, as is conventional, the powered drum 16 has spiral arrays of projecting, carbide-tipped, planing or cutting teeth. The teeth are so patterned that, with powered rotation (in a counterclockwise direction) of the drum 16, pavement cuttings are moved toward the center of the length of the drum 16 and onto a forwardly-directed conveyor 18.

Figure 2:
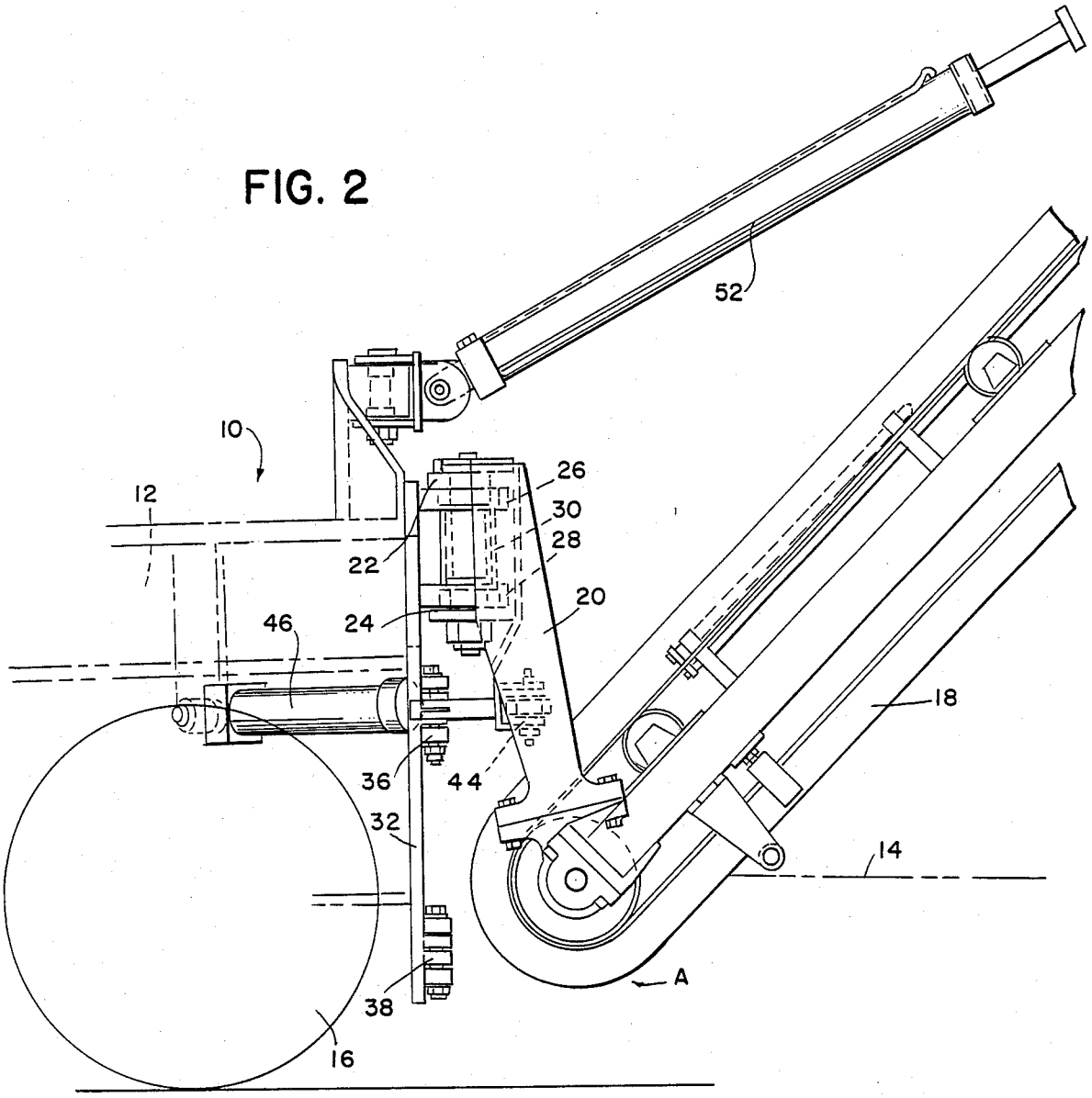
FIG. 2 is a side elevational view of substantially the same phantomed and full-lined portions of FIG. 1.

A portion of the conveyor 18 is shown in FIGS. 1 and 2. The down-stream end "A" of the conveyor 18 is coupled to, and pivotably journalled in, a lowermost end of a bifurcated structure, namely a yoke 20. An upper portion of the yoke 20 has a pair of parallel, horizontally-disposed plates 22 and 24. The plates 22 and 24 are set astride a corresponding pair of parallel, horizontally-disposed lobes 26 and 28. The plates 22 and 24, and lobes 26 and 28 have pivot-pin holes formed therein, and in common alignment, and a pivot pin 30 is removably secured in the holes.

The chassis 12 has a forward, access bulkhead 32. The latter is so named as it has an opening 34 formed therein through which to pass pavement cuttings to the conveyor 18, and it affords access to the drum 16 for servicing of the latter. The bulkhead 32 is vertically pivoted on the chassis 12 by means of hinges 36 and 38 secured to one side of the bulkhead 32 and a structure 40 of the chassis 12. The opposite side of the bulkhead 32 has a latch (not shown) manipulatable for holding the bulkhead 32 closed against a corresponding structure 42 of the chassis 12, or for releasing the bulkhead 32 in order that it might pivot on the hinges 36 and 38.

The aforementioned lobes 26 and 28 are integral with, and project from the bulkhead 32. Accordingly, then, it can be appreciated that, if the bulkhead 32 is unlatched and pivoted on the hinges 36 and 38, the conveyor 18 will be slued across the travel axis 14.

As shown in FIG. 2, the bulkhead 32 is in a confronting adjacency to the drum 16. So, with a pivoted opening of the bulkhead 32, one has a clear access to the drum 16 for its servicing.

An ear 44, projecting from a side of the yoke 20 receives the piston rod end of a hydraulic cylinder 46. The chassis 12 receives the opposite end of the cylinder 46. By extension and retraction of the piston rod, and with the bulkhead securely latched to structure 42, the conveyor is slued from side-to-side through shallow angles as represented (in FIG. 1) by "B" and "C". This is to accommodate for the directed off-loading of the pavement cuttings from the conveyor 18 to a dump truck (or the like); it allows the upstream end of the conveyor 18 to be selectively positioned relative to the truck. Abutment blocks 48 and 50, extending from plate 22 close upon and engage the bulkhead 32 to define the limits of the aforesaid, shallow, sluing angles. To slue the conveyor 18 fully to the left (of axis 14) the bulkhead 32 is unlatched, and the position rod of cylinder 46 is fully retracted. In this, abutment block 48 closes upon and engages the bulkhead 32, and then the bulkhead 32 swings open on the hinges 36 and 38. The stroke of the piston rod of cylinder 46 is such as to assure that the conveyor 18 will not slam into the chassis—to damage either the chassis or the conveyor.

Figure 3:
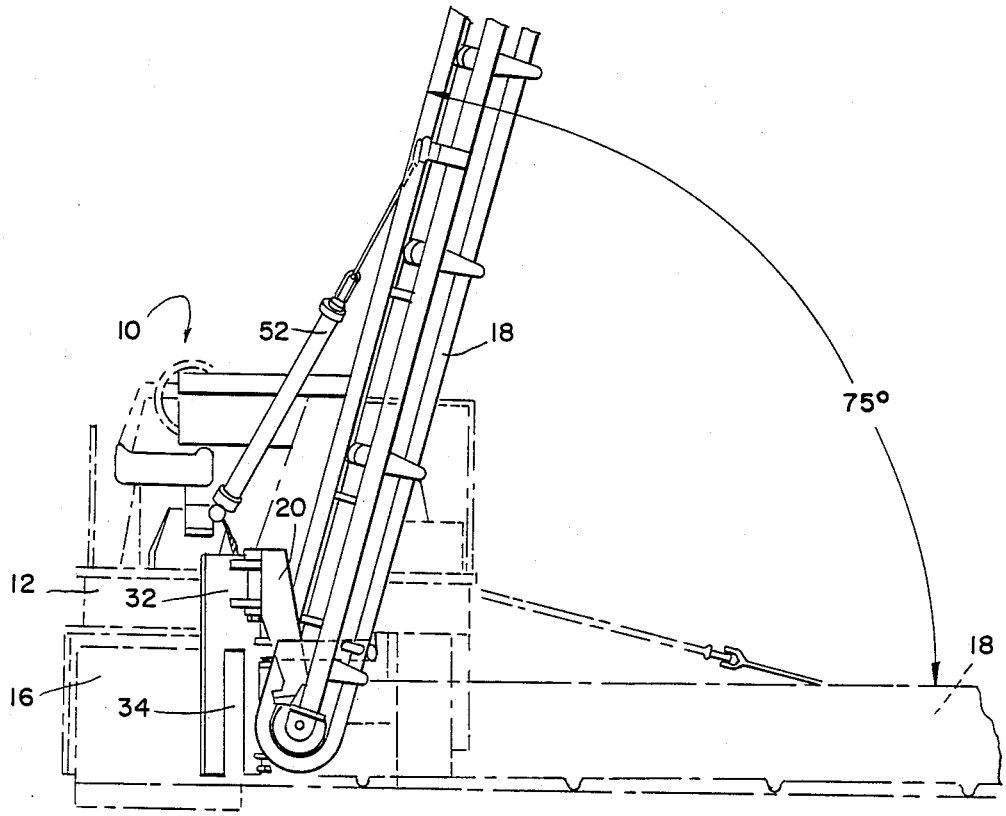
FIG. 3 is a front, elevational view of the planer chassis (in phantom), and showing the conveyor slued to the side and elevated, in approximately one-third the scale of FIGS. 1 and 2.

As is quite conventional, another hydraulic cylinder 52, attached at opposite ends to the chassis 12 and conveyor 18, is provided for elevating the conveyor. FIG. 3 shows the conveyor 18 raised to a full height (seventy-five degrees of arc) from a lowest disposition (shown in phantom) parallel with ground level. Too, FIG. 3 shows the bulkhead 32 opened, with the thereto-mounted conveyor 18 slued to one side, and the drum 16 exposed for servicing.

While I have described my invention in connection with a specific embodiment thereof, it is to be clearly understood that this is done only by way of example and not as a limitation to the scope of the invention as set forth in the objects thereof and in the appended claims.

I claim:

1. A pavement planer, comprising:

a chassis having a given, horizontal travel axis;

a planer element carried by said chassis; and an extended conveyor; wherein said chassis has a bulkhead, mounted in confronting adjacency to, and defining a wall extending across, said planer element;

said bulkhead has an opening formed therein to accommodate a discharge of pavement cuttings therethrough and conduct of such cuttings to said conveyor;

said bulkhead is mounted, as aforesaid, for pivotable movement, relative to said chassis, about a vertical axis, to expose, and thereby provide access to, said planer element for servicing of the latter; and said conveyor is mounted, at one end thereof, to said bulkhead; whereby said conveyor is slued across said travel axis upon said bulkhead being pivoted about said vertical axis.

2. A pavement planer, according to claim 1, further including:

a yoke; and wherein said yoke is fastened to said one end of said conveyor, and is pivotably coupled to said bulkhead.

3. A pavement planer, according to claim 2, further including:

power means, coupled to said yoke and to said chassis for pivoting (a) said yoke, and (b) said bulkhead.

4. A pavement planer, comprising:

a chassis having a given, horizontal, travel axis;

a planer element carried by said chassis; and an extended conveyor; wherein said chassis has an access bulkhead, mounted for pivotable movement about a vertical axis, in confronting adjacency to said planer element; and said conveyor is mounted, at one end thereof, to said bulkhead; whereby said conveyor is slued across said travel axis upon said bulkhead being pivoted about said vertical axis, and further including a yoke; and wherein said yoke is fastened to said one end of said conveyor, and is pivotably coupled to said bulkhead;

said bulkhead has a pair of lobes projecting horizontally therefrom;

said yoke has a pair of horizontally-disposed plates;

said lobes and plates have pivot-pin holes formed therein, and in common alignment; and a pivot pin in penetration of said holes.

5. A pavement planer, comprising:

a chassis having a given, horizontal, travel axis;

a planer element carried by said chassis; and an extended conveyor; wherein said chassis has an acccess bulkhead, mounted for pivotable movement about a vertical axis, in confronting adjacency to said planer element; and said conveyor is mounted, at one end thereof, to said bulkhead; whereby said conveyor is slued across said travel axis upon said bulkhead being pivoted about said vertical axis; further including a yoke; wherein said yoke is fastened to said one end of said conveyor, and is pivotably coupled to said bulkhead; and power means, coupled to said yoke and to said chassis for pivoting (a) said yoke, and (b) said bulkhead; wherein said yoke has abutment surfaces, for closing upon and engaging a surface of said bulkhead, cooperative with said power means for causing said bulkhead to pivot.

6. A pavement planer, according to claim 4, wherein:

at least one of said plates has abutment surfaces, for closing upon and engaging a surface of said bulkhead, cooperative with said power means for causing said bulkhead to pivot.

7. A pavement planer, according to claim 3, wherein:

said power means comprises means for preventing a slued over-travel of said conveyor.

* * * * *